US007278516B2

(12) United States Patent
Zalewski et al.

(10) Patent No.: US 7,278,516 B2
(45) Date of Patent: Oct. 9, 2007

(54) APPARATUS AND METHOD FOR BEARING LUBRICATION IN TURBINE ENGINES

(75) Inventors: George J. Zalewski, Scottsdale, AZ (US); Daniel J. Robinson, Scottsdale, AZ (US); Mark Kyler, Mesa, AZ (US); Donn Loper, Scottsdale, AZ (US)

(73) Assignee: Honeywell International, Inc., Morristown, NJ (US)

( * ) Notice: Subject to any disclaimer, the term of this patent is extended or adjusted under 35 U.S.C. 154(b) by 676 days.

(21) Appl. No.: 10/797,844

(22) Filed: Mar. 9, 2004

(65) Prior Publication Data

US 2005/0199445 A1 Sep. 15, 2005

(51) Int. Cl.
*F01M 1/04* (2006.01)

(52) U.S. Cl. ..... 184/6.5; 184/6.11

(58) Field of Classification Search ..... 184/6.5, 184/6.11

See application file for complete search history.

(56) References Cited

U.S. PATENT DOCUMENTS 3,312,448 A 4/1967 Hull, Jr. et al.
3,884,110 A * 5/1975 Leonard ..... 84/471 R
4,972,671 A 11/1990 Asselin et al.
5,316,346 A 5/1994 Maurer
5,746,574 A 5/1998 Czachor et al.
6,102,577 A 8/2000 Tremaine
6,438,938 B1 8/2002 Burkholder et al.

OTHER PUBLICATIONS

PCT International Search, Report PCT/US2005/008030, Dec. 22, 2005.

* cited by examiner

*Primary Examiner*—David M. Fenstermacher
(74) *Attorney, Agent, or Firm*—Ingrassia Fisher & Lorenz

(57) ABSTRACT

A lubrication system includes an inlet conduit having an inboard end attached to a bearing support and an outboard end for receiving lubricant. A lubricant inlet assembly is attached to the inlet conduit outboard end and has an inlet cap with a receptacle, an inlet cap body, and a cap base. The inlet receptacle is configured to mate with a lubricant supply line, where the inlet cap body has an outer cap enclosing an inner cap, the outer cap having a convoluted wall. An inlet conduit termination fitting has an outboard fitting section, with an o-ring in a circumferential groove, disposed inside the inlet cap, and an inboard fitting section attached to the inlet conduit outboard end. A cap heat shield encloses the inlet cap and a conduit heat shield is attached to the inlet conduit. The lubricant inlet assembly is mounted to an engine casing with a low-conductivity insulating gasket between the cap base and the engine casing.

45 Claims, 11 Drawing Sheets

APPARATUS AND METHOD FOR BEARING LUBRICATION IN TURBINE ENGINES

GOVERNMENT RIGHTS

This invention was made with Government support under Contract No. DAAH23-02-C-0122 awarded by the United States Army. The Government has certain rights in this invention.

BACKGROUND OF THE INVENTION

The present invention generally relates to bearing lubrication and, more specifically, to an improved apparatus and method for providing lubrication to bearing supports in turbine engines.

Shaft-driven machinery, such as gas turbine machinery, typically include a centrally-located shaft mounted in support bearings rotating about an engine axis and housed in an engine casing. Lubrication, in the form of oil, is usually provided to the support bearings by means of an oil supply line provided to the engine casing, with the supply line usually attached to an internal lubricant inlet conduit connected to the bearing support. Scavenge oil may be removed from the bearing support and re-used after cooling and deaerating. A vent assembly may also be provided at the engine casing to remove air or an air/lubricant mixture from the bearing support.

During normal operation, the rotating shaft generates substantial heat which flows to the support bearings. The support bearings and the engine casing are further heated as additional thermal energy is generated by fuel that is consumed during turbine operation to produce a high-temperature gaseous flow stream. In addition to lubricating the support bearings, the process of circulating the oil serves to remove heat from the bearings so as to prevent overheating.

When the oil supply line is attached to an inlet conduit which is attached to the bearing support, a tight oil seal is formed and helps to prevent oil leakage into the turbine engine. However, as the turbine components and the inlet conduit expand and contract during normal operating conditions, this configuration produces stress and undesirable movement between the turbine components and the inlet conduit. This movement may result in leakage between the shaft, the bearing support, the inlet conduit, and the oil supply line.

One method to alleviate the problems resulting from high thermal gradients and associated thermal stresses is to use an o-ring configuration so as to allow limited movement while preventing oil leakage, as exemplified in U.S. Pat. No. 6,102,577 issued to Tremaine. The reference discloses a bearing gallery thermal movement isolation device comprising an o-ring disposed between an oil transfer tube and a sleeve to allow relative sliding motion while providing an oil-tight seal. However, the reference further discloses that, because the operating temperature of the bearing gallery may reach 375° F., use of a conventional o-ring material may result in failure of the oil pressure seal. Accordingly, the disclosed configuration requires the use of a specialized o-ring material.

In an alternative design configuration, a metal bellows is used to allow expansion and contraction while providing an air seal. FIG. 1 is an axial section view of a conventional turbine engine 10 illustrating a turbine bearing support assembly 20 with an internal rotating shaft 11. The shaft 11 is secured in a bearing support 13 which is disposed within an engine casing 15. Oil is supplied to the bearing support

13 via a lubricant inlet assembly 21 and an inlet conduit 23. A vent assembly 25 and a vent conduit 27 are provided as part of an internal pressure regulation system. A first scavenge port 31 and a second scavenge port 33 are provided for removal or circulation of the lubricant via a first scavenge conduit 35 and a second scavenge conduit 37, respectively. There may also be provided a buffer air port 39 and a buffer air conduit 41.

Thermal energy generated during normal operation produces elevated temperatures in the lubricant and in the various components comprising the turbine engine 10. The engine casing 15, for example, is directly exposed to hot gases or products of combustion, while the various conduits 23, 27, 35, 37, and 41 provide containment for the relatively cooler lubricant circulating through the bearing support 13. As noted above, temperature gradients are produced within the turbine engine 10 and cause different rates of expansion among the various engine components.

For example, when the turbine engine 10 is initially started, the temperature of the engine casing 15 may increase from ambient to as much as 1400° F., increasing at a rate different from the increase in temperature of the inlet conduit 23 which will remain relatively cooler than the engine casing 15. This process results in different rates of expansion and relative movement between the inlet conduit 23 and the surrounding structure. For example, initially the diameter of the engine casing 15 will increase while the length of the inlet conduit 23 will remain about the same. This will produce a movement between the engine casing 15 and an inlet receptacle 45, shown in FIG. 2.

Accordingly, in the present state of the art, the lubricant inlet assembly 21 may include a collar-like bellows 43 disposed between the inlet receptacle 45 and the inlet conduit 23. The bellows 43, which may be made of a thin sheet of metal alloy, provides a means of containing the hot gases while allowing for relative movement of the inlet conduit 23 and receptacle 45 as the turbine engine 10 continues to operate. This design, however, suffers from the shortcoming in that vibrational forces generated during normal operation cause cracks in the bellows 43 and result in air leakage.

As can be seen, there is a need for an improved apparatus and method that provides a closed lubrication system while operating in the demanding temperature environment of shaft-driven machinery.

SUMMARY OF THE INVENTION

In one aspect of the present invention, a lubrication system comprises an inlet conduit having an inboard end attached to a bearing support and an outboard end for receiving lubricant; a lubricant inlet assembly attached to the inlet conduit outboard end including an inlet cap having a receptacle and an inlet cap body, the inlet receptacle configured to mate with a lubricant supply line, the inlet cap body having an outer cap enclosing an inner cap; an inlet conduit termination fitting having an outboard fitting section with a circumferential groove and disposed inside the inlet cap; an inboard fitting section attached to the inlet conduit outboard end; and an inlet o-ring disposed in the groove. Generally, the present invention is not limited to gas turbine engines and can be used when providing a fluid via a supply line to a mechanical system operating in a high-temperature environment, where the supply line comprises an o-ring to provide a seal between the fluid and the ambient environment.

In another aspect of the present invention, a lubricant inlet assembly comprises an inlet cap having a receptacle configured to mate with a lubricant supply line; a cap body having an outer cap enclosing an inner cap, and a cap base, the outer cap having a convoluted wall; an inlet conduit termination fitting disposed inside the inner cap and including a first section with an o-ring in a circumferential groove and a second section attached to the outboard end of an inlet conduit.

In a further aspect of the present invention, a lubricant inlet assembly comprises an inlet cap having a receptacle configured to mate with a lubricant supply line; a cap base attached to an engine casing; a cap heat shield enclosing the inlet cap; and an inlet conduit termination fitting attached to the outboard end of an inlet conduit and disposed inside the inlet cap.

In a still further aspect of the present invention, a scavenge port comprises a cap having a receptacle configured to mate with a lubricant removal line; a cap base attached to an engine casing; a low-conductivity insulator between the cap base and the engine casing; a conduit termination fitting attached to the outboard end of a scavenge conduit and disposed inside the cap; and a conduit heat shield enclosing the scavenge conduit so as to block radiation from the engine casing.

In yet another aspect of the present invention, a vent assembly comprises a cap having a receptacle configured to mate with a vent line; a cap base attached to an engine casing, the cap base having a circular ridge enclosing a circular recess; a low thermal conductivity insulator disposed between the cap base and the engine casing, the low thermal conductivity insulator enclosing the circular ridge; and a conduit termination fitting attached to the outboard end of the vent conduit and disposed inside the cap.

In still another aspect of the present invention, a lubrication system comprises an inlet conduit having an inboard end attached to a bearing support and an outboard end for receiving lubricant; a lubricant inlet assembly attached to the inlet conduit outboard end, the lubricant inlet assembly including an inlet cap having a receptacle configured to mate with a lubricant supply line; a cap body with an outer cap enclosing an inner cap; an inlet cap base; an inlet conduit termination fitting with a circumferential groove and an o-ring disposed in the groove, the inlet conduit termination fitting attached to the inlet conduit outboard end; a scavenge conduit having an inboard end attached to the bearing support and an outboard end for access in removing the lubricant; a scavenge port attached to the scavenge conduit outboard end, the scavenge port including an elbow cap having a receptacle configured to mate with a lubricant removal line; a cap body having an outer cap enclosing an inner cap; a cap base; a conduit termination fitting with a circumferential groove and an o-ring disposed in the groove, the scavenge port conduit termination fitting attached to the scavenge conduit outboard end; a buffer air conduit having an inboard end attached to the bearing support and an outboard end; a buffer air port attached to the buffer air conduit outboard end, the buffer air port including a buffer air cap having a cap body, a buffer air elbow, and a buffer air cap base; and a buffer air conduit termination fitting with two circumferential grooves and two piston rings disposed in the grooves, the buffer air conduit termination fitting attached to the buffer air conduit outboard end.

In an additional aspect of the present invention, a lubrication system comprises a lubricant inlet assembly including an inlet cap having an inlet receptacle configured to mate with a lubricant supply line; an inlet cap body with an outer inlet cap enclosing an inner inlet cap; an inlet cap base for attachment to an engine casing, the outer inlet cap having a convoluted wall; an inlet conduit termination fitting with a circumferential groove and an inlet o-ring disposed in the groove, the inlet conduit termination fitting attached to an outboard end of an inlet conduit; a cap heat shield enclosing the inlet cap; a conduit heat shield attached to the inlet conduit; a low-conductivity insulator between the inlet cap base and the engine casing; a vent assembly including an elbow cap having an outer cap enclosing an inner cap; a cap base for attachment to the engine casing, the outer cap having a convoluted wall; a conduit termination fitting with a circumferential groove and an o-ring in the groove, the vent assembly conduit termination fitting attached to an outboard end of a vent conduit; a cap heat shield enclosing the vent assembly elbow cap; a conduit heat shield attached to the vent conduit, a low conductivity insulator between the vent assembly cap base and the engine casing; a first scavenge port including an elbow cap configured to mate with a first lubricant removal line; a cap body having an outer cap enclosing an inner cap; a cap base for attachment to the engine casing, the first scavenge port outer cap having a convoluted wall; a conduit termination fitting with a circumferential groove and an o-ring in the groove, the first scavenge port conduit termination fitting attached to an outboard end of a first scavenge conduit; a cap heat shield enclosing the first scavenge port elbow cap; a conduit heat shield attached to a first scavenge conduit; a low conductivity insulator between the first scavenge port cap base and the engine casing; a buffer air port including a buffer air cap having a buffer air cap body; a buffer air elbow; a buffer air cap base for attachment to the engine casing; a buffer air conduit termination fitting with two circumferential buffer air grooves and two buffer air piston rings in respective buffer piston grooves, the buffer air conduit termination fitting attached to an outboard end of a buffer air conduit; a cap heat shield enclosing the buffer air cap; a conduit heat shield attached to the buffer air conduit; and a low conductivity insulator between the buffer air cap base and the engine casing.

In still another aspect of the present invention, a lubrication system for retrofitting a turbine engine comprises a lubricant inlet assembly including an inlet cap having an inlet receptacle configured to mate with a lubricant supply line; an inlet cap body with an outer inlet cap enclosing an inner inlet cap; an inlet cap base for attachment to an engine casing, the outer inlet cap having a convoluted wall; an inlet conduit termination fitting with a circumferential groove and an inlet o-ring in the groove, the inlet conduit termination fitting attached to an outboard end of an inlet conduit; a cap heat shield enclosing the inlet cap; a conduit heat shield attached to the inlet conduit; a low conductivity insulator between the inlet cap base and the engine casing; a vent assembly including an elbow cap having an outer cap enclosing an inner cap; a cap base for attachment to the engine casing, the outer cap having a convoluted wall; a conduit termination fitting with a circumferential groove and an o-ring in the groove, the vent assembly conduit termination fitting attached to an outboard end of a vent conduit; a cap heat shield enclosing the vent assembly elbow cap; a conduit heat shield attached to the vent conduit; a low conductivity insulator disposed between the vent assembly cap base and the engine casing; a scavenge port including an elbow cap configured to mate with a lubricant removal line; a cap body having an outer cap enclosing an inner cap; a cap base for attachment to the engine casing, the scavenge port outer cap having a convoluted wall; a conduit termination fitting with a circumferential groove and an o-ring in the groove, the scavenge port conduit termination fitting attached to an outboard end of a scavenge conduit; a cap heat shield enclosing the scavenge port elbow cap; a conduit heat shield attached to the scavenge conduit; a low conductivity insulator between the scavenge port cap base and the engine casing; a buffer air port including a buffer air cap having a buffer air cap body; a buffer air elbow; a buffer air cap base for attachment to the engine casing; a buffer air conduit termination fitting with two circumferential buffer air grooves and two buffer air piston rings in respective piston grooves, the buffer air conduit termination fitting attached to an outboard end of a buffer air conduit; a cap heat shield enclosing the buffer air cap; a conduit heat shield attached to the buffer air conduit; and a low-conductivity insulator between the buffer air cap base and the engine casing.

In accordance with the present invention, a method of providing lubrication from a lubricant supply line to a support bearing comprises the steps of attaching an outboard end of an inlet conduit to a lubricant inlet assembly, the lubricant inlet assembly including an inlet conduit termination fitting having an inlet o-ring disposed in a circumferential groove, the inlet conduit termination fitting attached to the inlet conduit outboard end; an inlet cap having an inlet receptacle configured to mate with the lubricant supply line; an inlet cap body with an outer inlet cap enclosing an inner inlet cap; an inlet cap base for attachment to an engine casing, the outer inlet cap having a convoluted wall, the inner inlet cap enclosing the inlet o-ring; and providing lubricant to the bearing support via the inlet receptacle and the lubricant supply line.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention is an apparatus and method for providing lubrication to support bearings in a turbine engine wherein the lubrication apparatus includes novel features to reduce equilibrium operating temperatures at all apparatus-to-engine-casing interfaces. Radiation shields may be used to block thermal radiation from the engine casing, and low conductivity gaskets may be disposed between the lubrication apparatus access caps and the engine casing to reduce conductive heat flow from the engine. The lubrication apparatus access caps may have a double-wall construction, with an outside wall being convoluted to provide greater cooling. Heat buildup is thereby reduced and operating temperatures are lowered. Accordingly, the temperatures of metal components in contact with the lubricant are advantageously reduced below the temperature at which 'coking' of the lubricant might occur. The incidence of coking is reduced or eliminated. Conventional turbine engine designs, in comparison, fail to adequately reduce heat buildup in such interfaces and instead rely on high-temperature materials for operational reliability.

Figure 3:
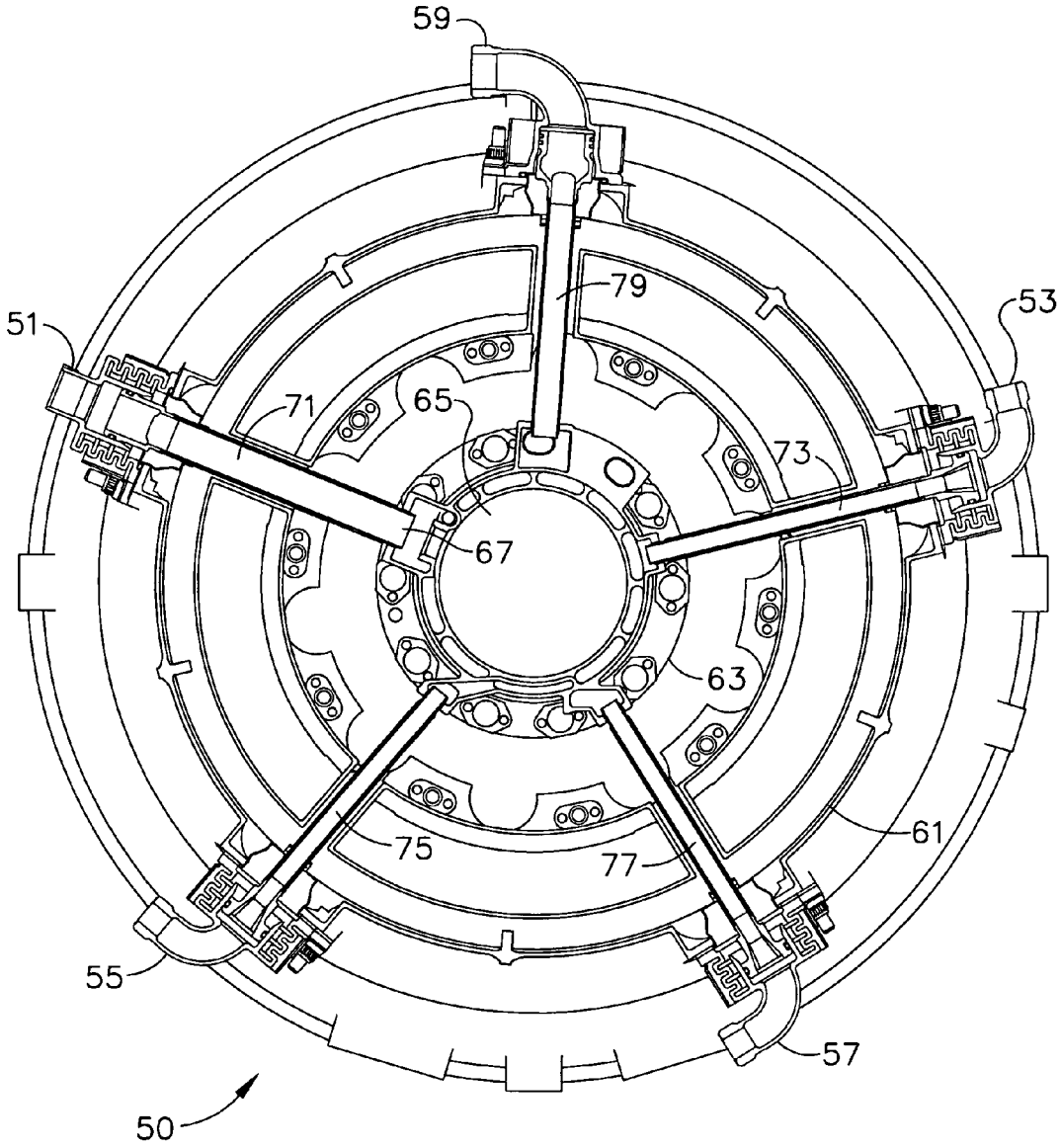
FIG. 3 is a section view of a gas turbine assembly including a lubricant inlet assembly, a vent assembly, first and second scavenge ports, and a buffer air port configured in accordance with the present invention.

In one embodiment, shown in the axial section view of FIG. 3, a bearing support assembly 50 may include a lubricant inlet assembly 51, a vent assembly 53, a first scavenge port 55, a second scavenge port 57, and a buffer air port 59 mounted to an engine casing 61. The bearing assembly 50 may also include a bearing support 63 used to secure an internal rotating shaft 65. Lubricant provided at the lubricant inlet assembly 51 can be provided to the bearing support 63 via an inlet conduit 71. An inboard end 67 of the inlet conduit 71 may be structurally attached to the bearing support 63, for example, by brazing.

A vent conduit 73 can connect the vent assembly 53 with the bearing support 63. Both the first scavenge port 55 and the second scavenge port 57 may be used to convey lubricant from the bearing support 63 via a first scavenge conduit 75 and a second scavenge conduit 77, respectively. A buffer air conduit 79 can run from the buffer air port 59 to the bearing support 63. Respective inboard ends of the vent conduit 73, the first scavenge conduit 75, the second scavenge conduit 77, and the buffer air conduit 79 can likewise be structurally attached to the bearing support 63, such as by brazing.

Figure 4:
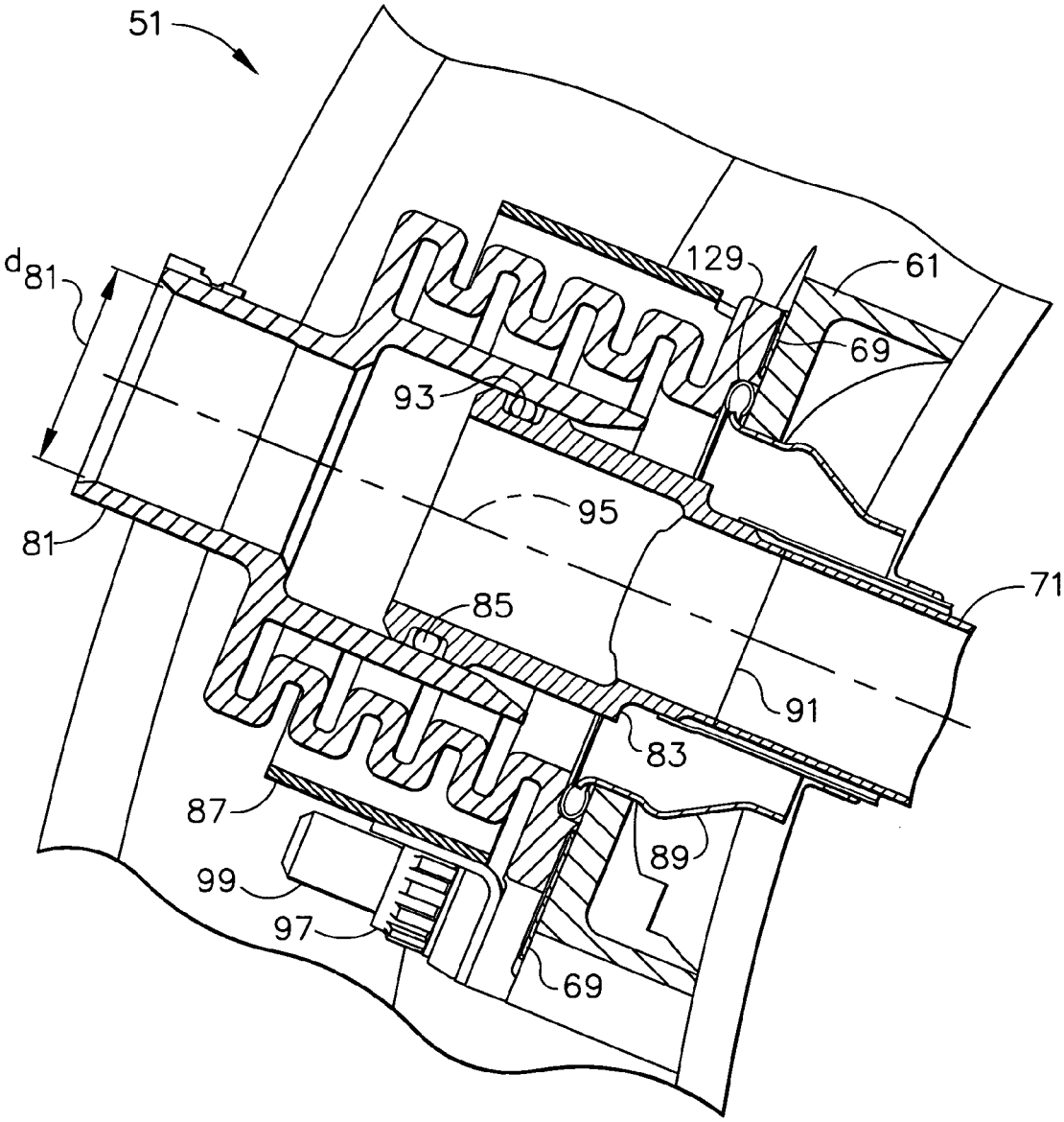
FIG. 4 is a detail view of the lubricant inlet assembly of FIG. 3.

The lubricant inlet assembly 51, shown in greater detail in FIG. 4, may include an inlet cap 81, an inlet conduit termination fitting 83, and an inlet o-ring 85. The lubricant inlet assembly 51 may further include a cap heat shield 87 and a conduit heat shield 89. The inlet conduit termination fitting 83 may be attached to an outboard end of the inlet conduit 71 at an inlet interface seam 91 by brazing, for example, or by another suitable method known in the relevant art. The inlet cap 81 may include an opening, shown in FIG. 5, which may have an inside diameter '$d_5$' for retaining a C-seal 129.

Figure 6:
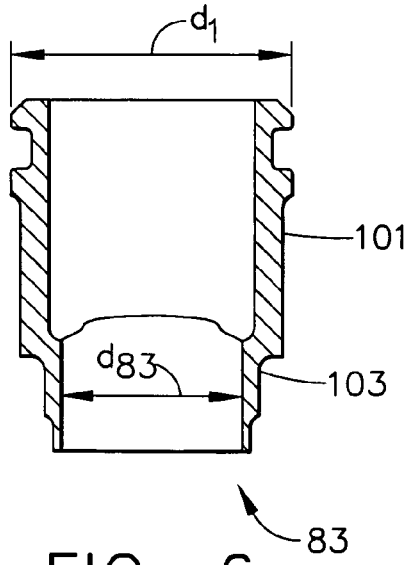
FIG. 6 is a detail view of an inlet conduit terminating fitting used in the lubricant inlet assembly of FIG. 4.

The inlet o-ring 85 can be seated in a circumferential groove 93 provided in the inlet conduit termination fitting 83, as shown in FIGS. 4 and 6. This configuration allows for relative movement of the inlet conduit termination fitting 83 inside the inlet cap 81 along a longitudinal axis 95 of the inlet conduit 71, shown in FIG. 4, as may result when the thermal expansions and contractions of the engine casing 61 and the inlet conduit 71, for example, occur during normal operating conditions. The inlet o-ring 85 may further function to maintain a seal between the inlet conduit termination fitting 83 and the inlet cap 81 when the inlet cap 81 is placed over the inlet conduit termination fitting 83 and fastened to the engine casing 61 by securing a nut 97 to an engine casing threaded stud 99. The C-seal 129 may be provided between the inlet cap 81 and the engine casing 61 to prevent air leakage between the interior of the engine casing 61 and the ambient atmosphere.

The inlet conduit termination fitting 83, shown in the cross-section view of FIG. 6, may include a cylindrical inboard fitting section 103 for attachment to the inlet conduit 71. This can allow for a less restricted flow of lubricant across the inlet interface seam 91 when there is provided a smooth internal transition from the inlet conduit termination fitting 83 to the inlet conduit 71. The inlet conduit termination fitting 83 may further include a cylindrical outboard fitting section 101 having an outside diameter '$d_1$'. Because of the presence of the groove 93, the cylindrical outboard fitting section 101 may have a relatively thick wall to retain structural integrity against the clamping action of the oil inlet cap 81.

Figure 1:
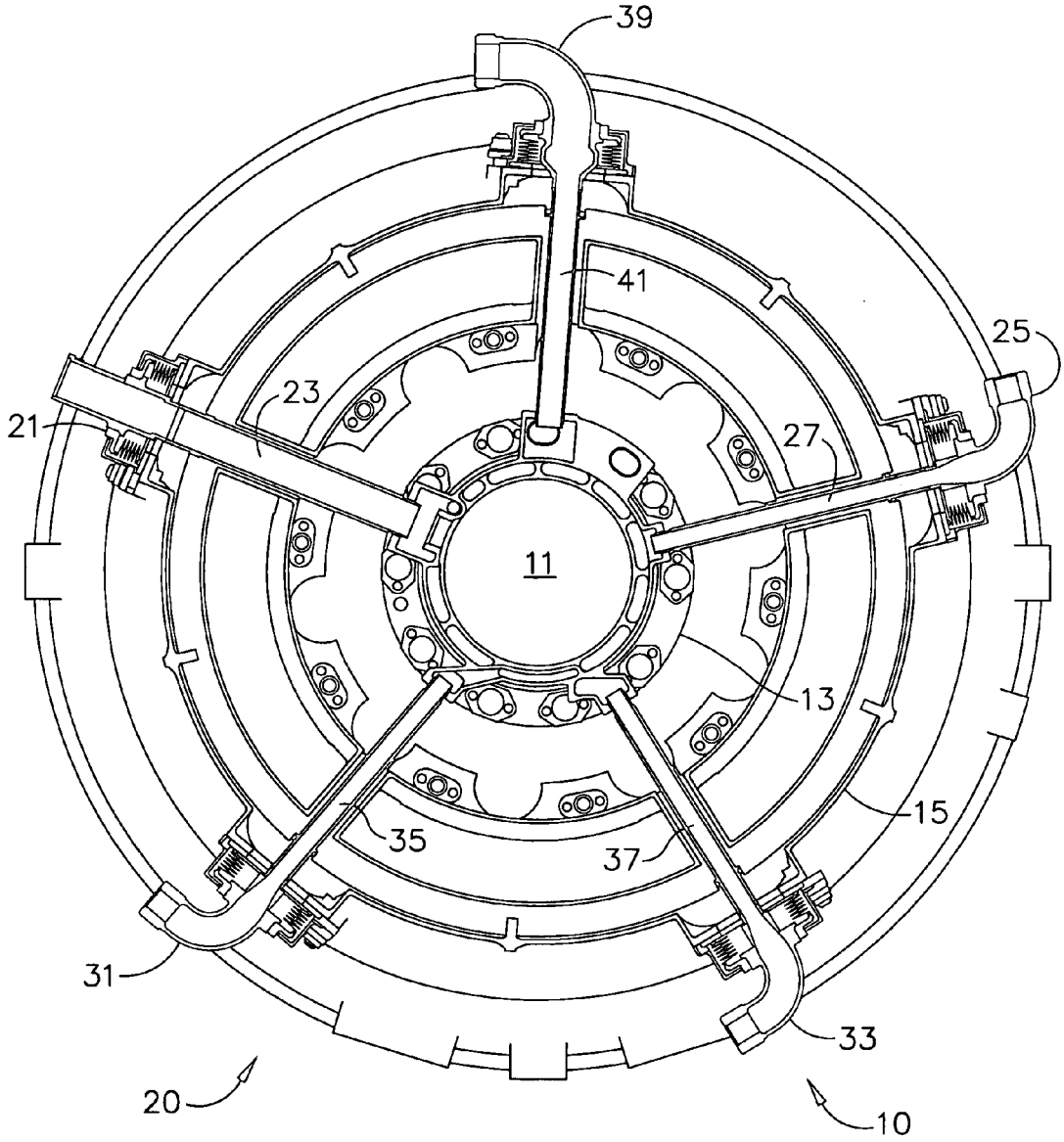
FIG. 1 (PRIOR ART)
FIG. 1 is an axial section view showing a lubricant inlet assembly of a conventional turbine engine, a vent assembly, two scavenge ports, and a buffer air port connected to an internal turbine bearing assembly.
Figure 2:
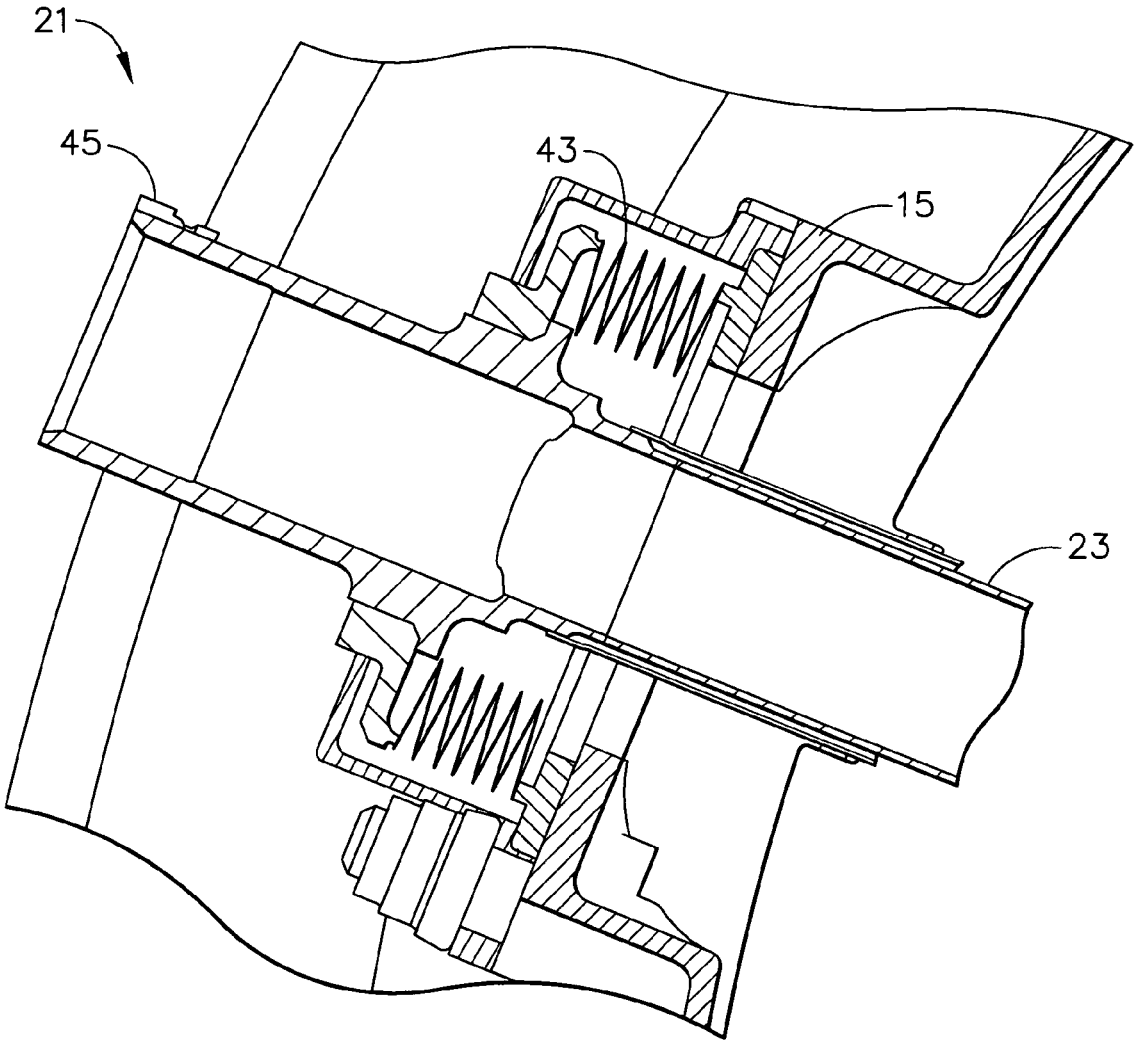
FIG. 2 (PRIOR ART)
FIG. 2 is a detail view of the lubricant inlet assembly of FIG. 1.
Figure 5:
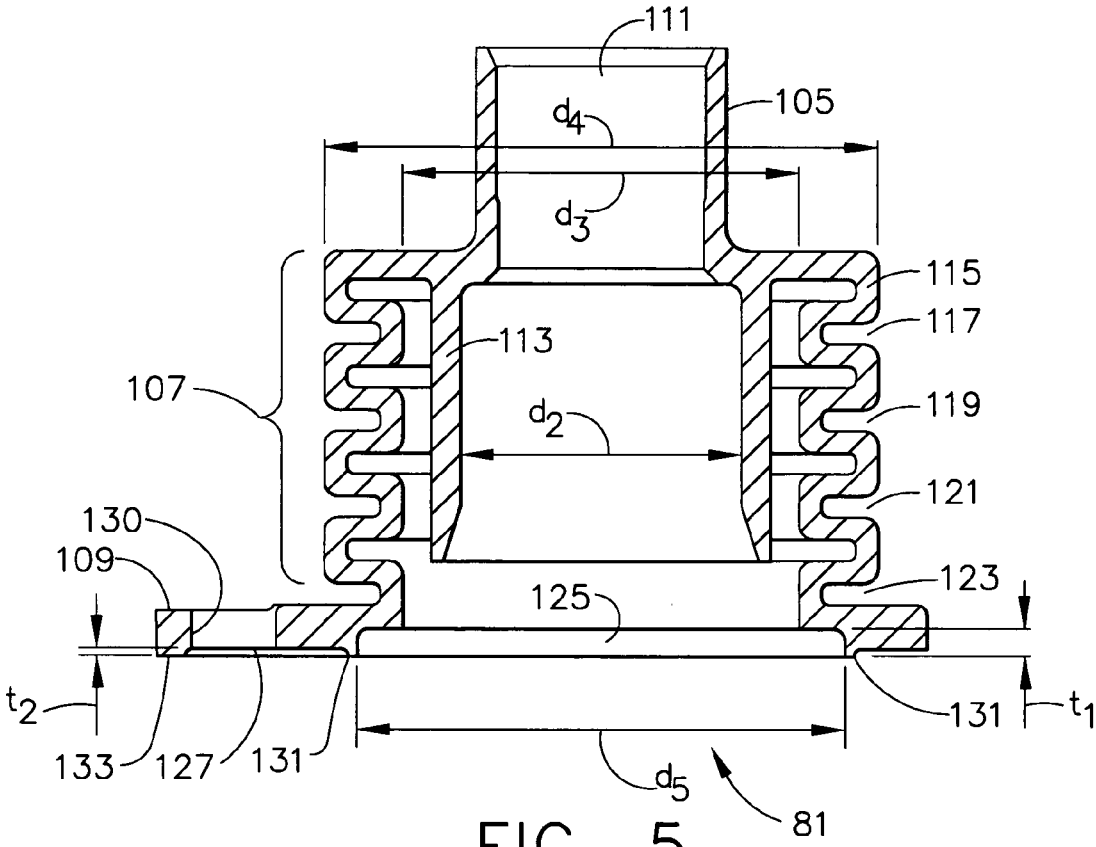
FIG. 5 is a detail view of an inlet cap used in the lubricant inlet assembly of FIG. 4.

The inlet cap 81, shown in the cross section view of FIG. 5, may include a cylindrical receptacle 105 for connection to the lubricant supply line (not shown) external to the engine casing 61, a cylindrical double-walled cap body 107 for mating to the inlet conduit termination fitting 83, and a cap base 109 for fastening to the engine casing 61 via mounting holes 130. The receptacle 105 may have an inlet opening 111 which conforms to the dimensions and shape of an inlet opening 22 on the lubricant inlet assembly 21, shown in FIG. 1, to provide for retrofitting and upgrade of the conventional turbine engine 10 by replacing the lubricant inlet assembly 21 with the lubricant inlet assembly 51.

As shown in FIG. 5, the double-walled cap body 107 may include an inner cap 113 with an inside diameter '$d_2$', where $d_2$ is larger than the outside diameter $d_1$ of the inlet conduit termination fitting 83. The cap body 107 may also include an outer cap 115 having an inside diameter '$d_3$' and an outside diameter '$d_4$' between which dimensions may lie a plurality of circumferential channels 117, 119, 121, and 123. As can be seen from the cross-sectional view, the wall of the outer cap 115 can be convoluted because of the channels 117, 119, 121, and 123. As a result, the convoluted wall of the outer cap 115 can present a longer thermal conductive path between the cap base 109 and the receptacle 105 than if the wall of the outer cap 115 had straight sides.

The cap base 109 may include a circular axial recess 125 having an inside diameter '$d_5$' and a depth '$t_1$' configured to accommodate positioning of the conduit heat shield 89 between the cap base 109 and the engine casing 61. There may also be provided an annular recess 127 having depth '$t_2$' as shown. A circular ridge 131 is thereby formed at the circumference of the axial recess 125. There may also be provided a first peripheral ridge 133 near the first mounting hole 130 and a similar second peripheral ridge (not shown for clarity of illustration) near the second mounting hole (not shown for clarity), where the first peripheral ridge 133 and the second peripheral ridge are each bounded by the annular recess 127 and by the outside periphery of the base 109.

The circular ridge 131, the first peripheral ridge 133, and the second peripheral ridge (not shown) are thereby configured to provide a small base footprint for the inlet cap 81. Additionally, when the cap base 109 is mounted against the engine casing 61, an insulating gasket 69, shown in FIG. 4, may be advantageously disposed in the annular recess 127 between the inlet cap 81 and the engine casing 61 such that the insulating gasket 69 encloses the circular ridge 131. The insulating gasket 69, which can be a low conductivity material, may function to inhibit the conductive transfer of heat from the engine casing 61 to the inlet cap 81 across the annular recess 127, and may further serve to restrict the conductive transfer of heat primarily to the relatively small cross section defined by the contact areas of the circular ridge 131, the first peripheral ridge 133, and the second peripheral ridge (not shown) against the engine casing 61.

Figure 7A:
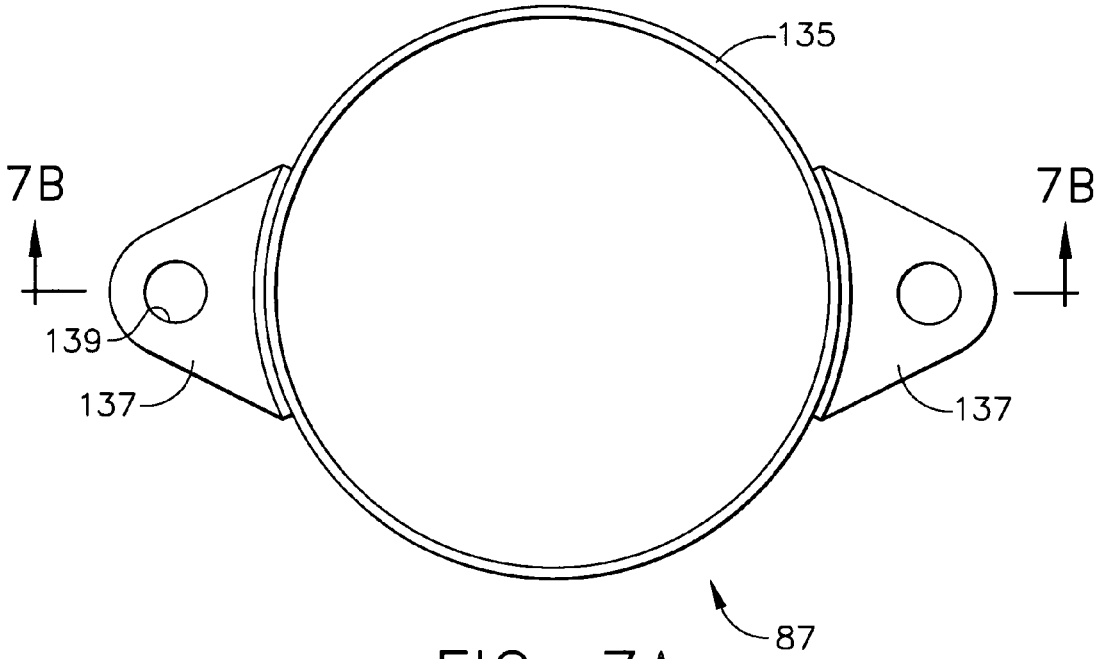
FIG. 7 is a detail view of a cap heat shield used in the lubricant inlet, buffer air, scavenge, and vent assemblies of FIG. 3.
Figure 7B:
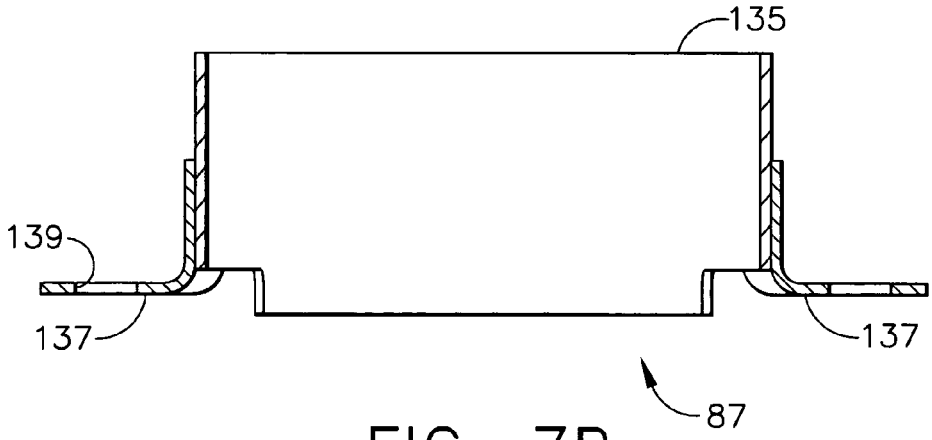

The cap heat shield 87, shown in the cross section view of FIG. 7, may include a thin-walled cylindrical shield 135 attached to two mounting brackets 137 which may be L-shaped as shown. The mounting brackets 137 may include bracket mounting holes 139 for attachment of the cap heat shield 87 to the engine casing 61 with the nut 97 and the engine casing threaded stud 99. The cylindrical shield 135 may have an inside diameter which is larger than the outside diameter $d_4$ of the outer cap 115 of the inlet cap 81. Accordingly, the mounting bracket 133 may be configured to provide support such that the cylindrical shield 135 encloses the outer cap 115 when the mounting bracket 137 and the inlet cap 81 are attached to the engine casing 61 as shown in FIG. 4.

Figure 8A:
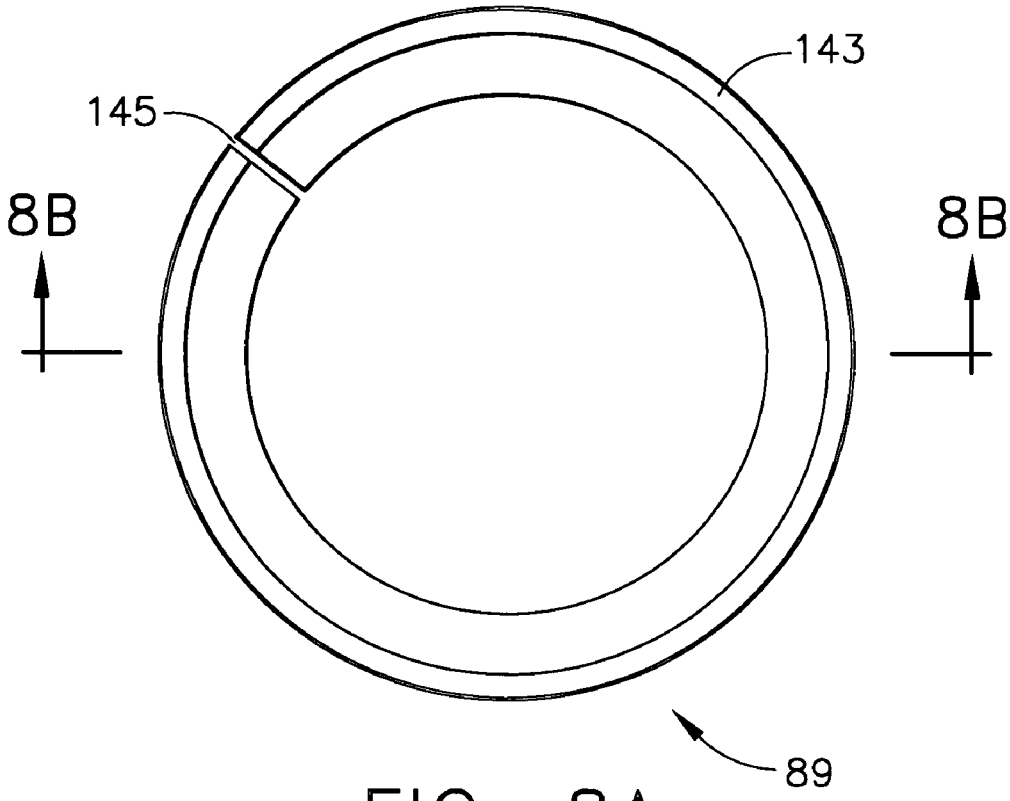
FIG. 8 is a detail view of a conduit heat shield used in the lubricant inlet, buffer air, scavenge, and vent assemblies of FIG. 3.
Figure 8B:
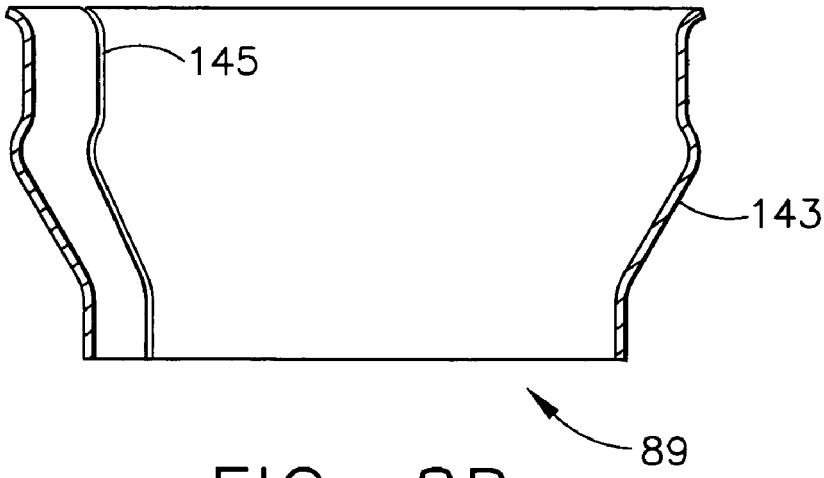

The conduit heat shield 89, shown in the cross section view of FIG. 8, may include a flared section 143 with a circumferential discontinuity 145 in the flared section 143 to allow the conduit heat shield 89 to close and provide a spring-like action by snapping the heat shield 89 into an opening in the engine casing 61. The cap heat shield 87 and the conduit heat shield 89 can be formed from a sheet metal alloy.

As can be appreciated by one skilled in the relevant art, the present invention works by means of reducing temperature buildup at the inlet assembly 51 by blocking radiation and by decreasing the amount of thermal energy flowing by conduction from the engine casing 61 to the inlet assembly 51. The inlet assembly 51 comprises certain thermodynamic design features which result in the inlet cap 81, for example, reaching a lower maximum operating temperature in comparison to a conventional configuration which does not incorporate these design features. A lower maximum operating temperature provides certain advantages including, for example, a longer operating life for the inlet o-ring 93.

As described above, the inlet cap 81 can include a cap body 107 with a double-cap configuration, where the thermal conductive path consisting of the footprint of the cap base 109, the convoluted wall of the outer cap 115, and the wall of the inner cap 113 function to provide a greater impediment to the conductive heat flowing from the engine casing 61 to the inlet o-ring 85. This heat flow is reduced by providing a minimum footprint of the cap base 109 against the engine casing 61, and by providing the insulating gasket 69 between the cap base 109 and the engine casing 61. In addition, the conduit heat shield 89 can function to block from the inlet conduit 71 and from the inlet conduit termination fitting 83 some of the thermal energy which may be radiating from the engine casing 61. Similarly, the cap heat shield 87 can function to block other thermal energy radiating from the engine casing 61 from reaching portions of the inlet cap 81.

It can be shown that each of these thermodynamic design features serves to reduce temperature at the inlet o-ring 85, and that these features can be used individually or in any combination to reduce maximum operating temperature for the inlet assembly 51 components. It can also be appreciated by one skilled in the relevant art that the cap heat shield 87 and the conduit heat shield 89 can be the primary components in blocking radiation and reducing temperatures at the inlet assembly 51, for example, when the turbine engine is operating and the engine casing 61 is hot. When the turbine engine is shut down and oil is no longer flowing in the inlet conduit 71, the convoluted wall of the outer cap 115, the small attachment footprint in the cap base 109, and the insulating gasket 69 can be the primary components in reducing conductive heat flow to the inlet assembly 51.

It should be understood that one or more of these thermodynamic design features may be provided in any or all of the inlet assembly 51, the vent assembly 53, the first scavenge port 55, the second scavenge port 57, and the buffer air port 59, shown in FIG. 3, without departing from the scope of the present invention. Moreover, a conventional turbine engine lubrication subsystem, such as the turbine bearing support assembly 20 shown in FIG. 1, can be upgraded or retrofitted by replacing any or all of the lubricant inlet assembly 21, the vent assembly 25, the first scavenge port 31, the second scavenge port 33, and the buffer air port 39, with a respective one of the lubricant inlet assembly 51, the vent assembly 53, the first scavenge port 55, the second scavenge port 57, and the buffer air port 59.

In a retrofit modification, the outboard end of the inlet conduit 23 may be reworked to provide for attachment to the inlet conduit termination fitting 83. Likewise, the outboard ends of one or more of the first scavenge conduit 35, the second scavenge conduit 37, and the vent conduit 27 may each be reworked for attachment to a corresponding conduit termination fitting 153, for example. Similarly, the outboard end of the buffer air conduit 41 may be reworked for attachment to a buffer air conduit termination fitting 193.

Figure 9:
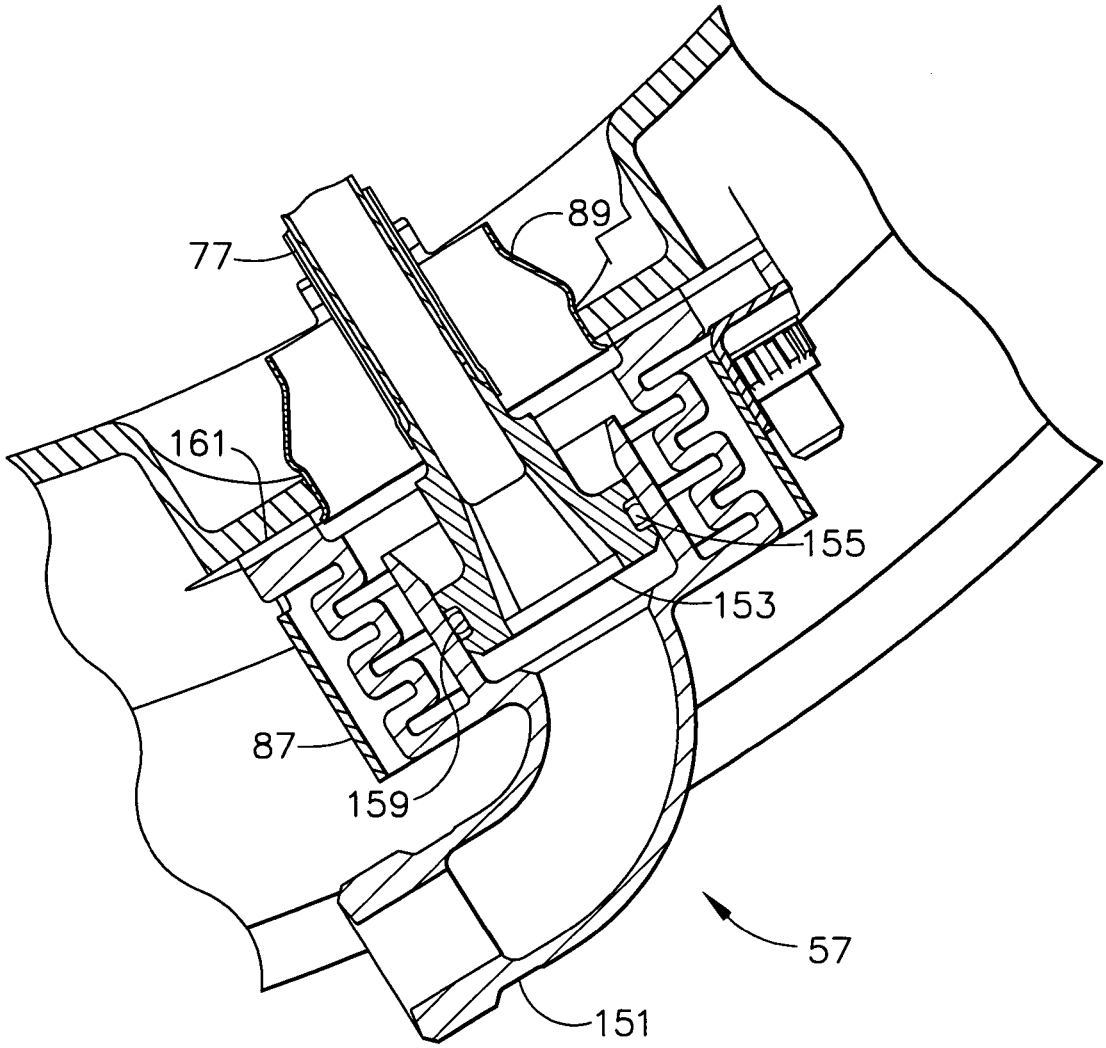
FIG. 9 is a detail view of the first scavenge port of FIG. 3.

In another embodiment, for example, the second scavenge port 57, shown in greater detail in FIG. 9, may include an elbow cap 151, a conduit termination fitting 153, and an o-ring 155. The second scavenge port 57 may further include the cap heat shield 87 and the conduit heat shield 89. The conduit termination fitting 153 may be attached to the second scavenge conduit 77 at a second scavenge interface seam 157 by any suitable method known in the relevant art. The o-ring 155 can be seated in a circumferential groove 159 provided in the conduit termination fitting 153.

Figure 10:
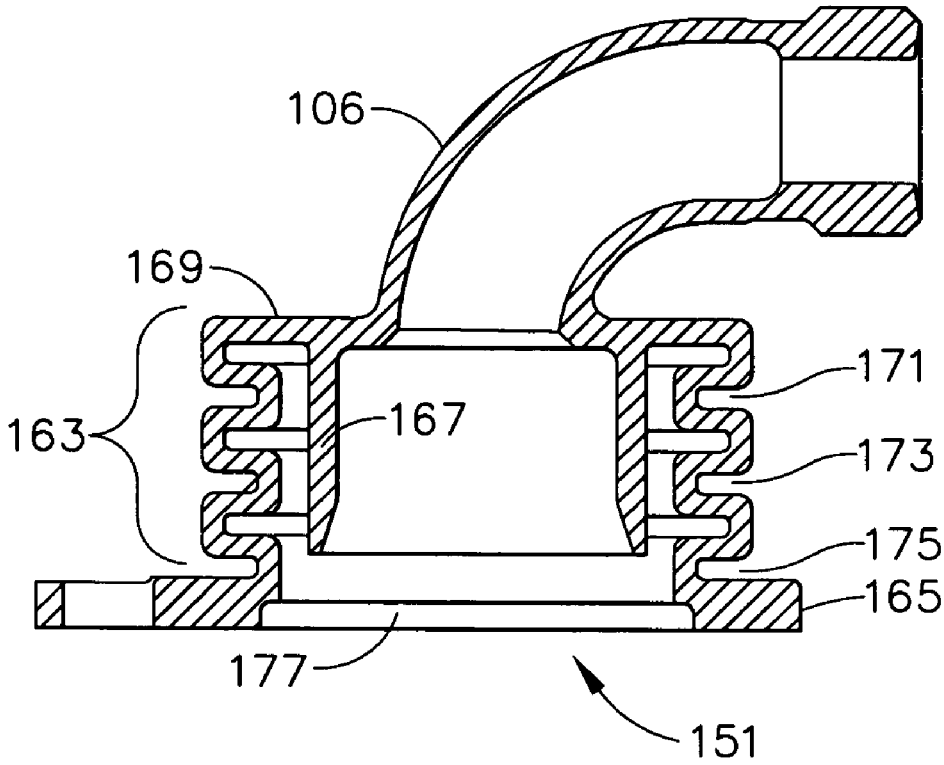
FIG. 10 is a detail view of a scavenge cap used in the first scavenge port of FIG. 9.

The elbow cap 151, shown in the cross section view of FIG. 10, may include a cylindrical elbow 106 for connection to either a lubricant removal line or a vent line, a cylindrical double-walled cap body 163 for mating to the conduit termination fitting 153, and a cap base 165 for fastening to the engine casing 61. The double-walled cap body 163 may include an inner cap 167 and may include an outer cap 169 which may have a plurality of circumferential channels 171, 173, and 175 to form a convoluted wall as shown. The cap base 165 may have an axial recess 177 configured to secure the conduit heat shield 89, as shown in FIG. 9.

Figure 11:
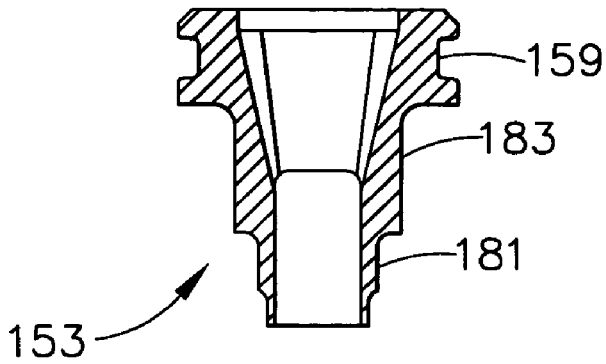
FIG. 11 is a detail view of a first scavenge conduit terminating fitting used in the first scavenge port of FIG. 9.

The conduit termination fitting 153, shown in the cross section view of FIG. 11, may include a cylindrical inboard fitting section 181 for attachment to an outboard end of the first scavenge conduit 75, the second scavenge conduit 77, or the vent conduit 73. The conduit termination fitting 153 may further include a flared outboard fitting section 183 sized to fit into the inner cap 167 of the elbow cap 151, as shown in FIG. 9. Other features and functions of the first scavenge port 55 may be similar to those of the inlet assembly 51.

Figure 12:
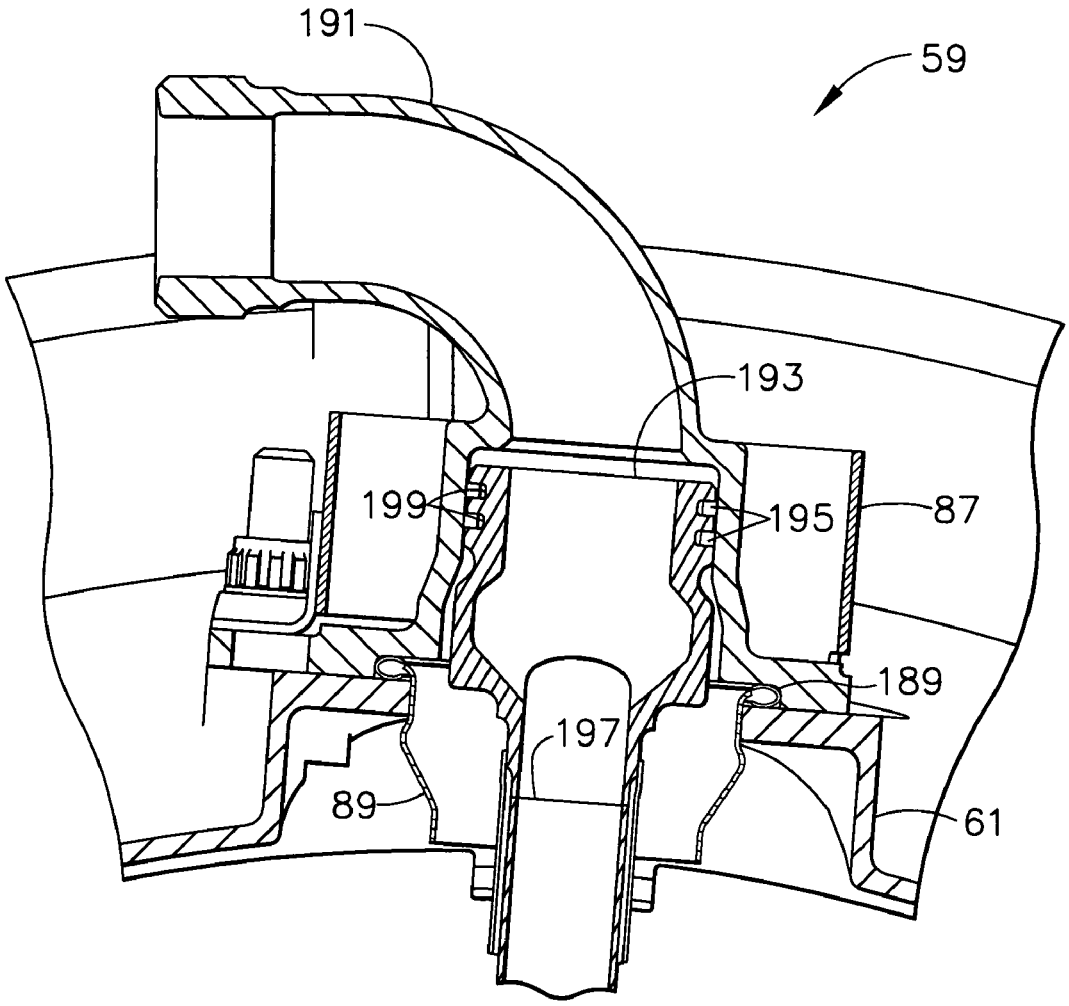
FIG. 12 is a detail view of the buffer air port of FIG. 3.

In yet another embodiment, the buffer air port 59, shown in FIG. 12, may include a buffer air cap 191, a buffer air conduit termination fitting 193, and a pair of metal piston rings 195. The buffer air port 59 may further include the cap heat shield 87 and the conduit heat shield 89. The buffer air conduit termination fitting 193 may be attached to the buffer air conduit 79 at a buffer air interface seam 197. The piston rings 195 can be seated in two respective circumferential grooves 199 provided in the buffer air conduit termination fitting 193.

Figure 13:
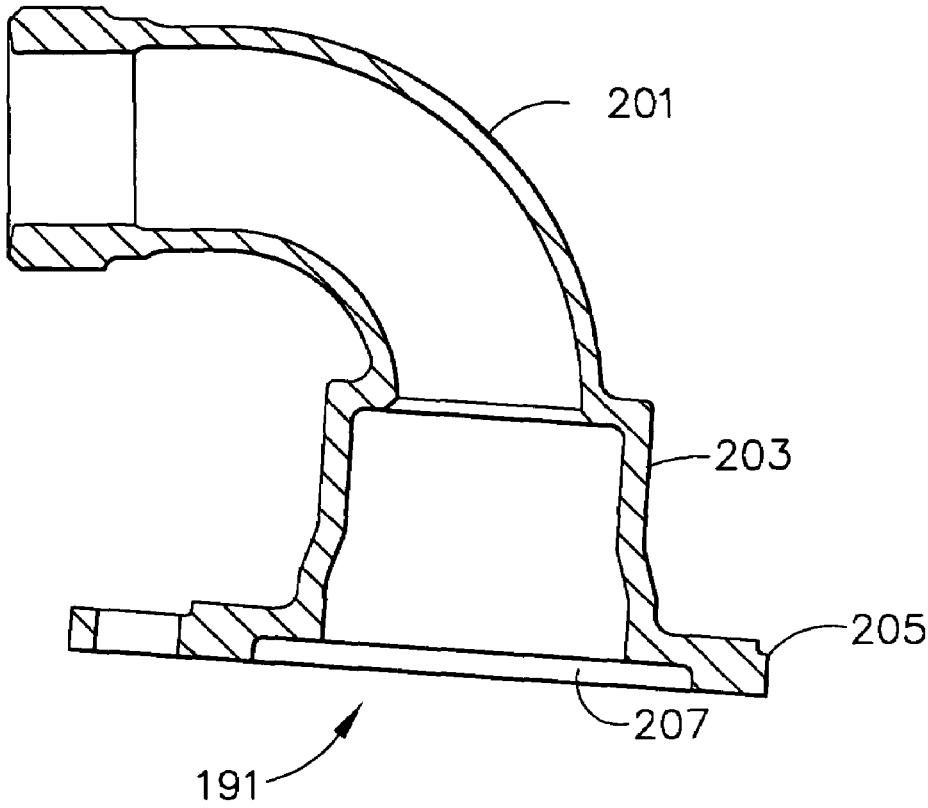
FIG. 13 is a detail view of a buffer air cap used in the buffer air port of FIG. 12.

The buffer air cap 191, shown in the cross section view of FIG. 13, may include a buffer air elbow 201 for connection to an air supply, a straight cylindrical buffer cap body 203 for mating to the buffer air conduit termination fitting 193, and a buffer air cap base 205 for fastening to the engine casing 61. The buffer air cap base 205 may have an axial recess 207 configured to secure the C-seal 189 and the conduit heat shield 89, as shown in FIG. 12. The C-seal 189 may be provided between the buffer air cap 191 and the engine casing 61 to prevent air leakage between the interior of the engine casing 61 and the ambient atmosphere.

Figure 14:
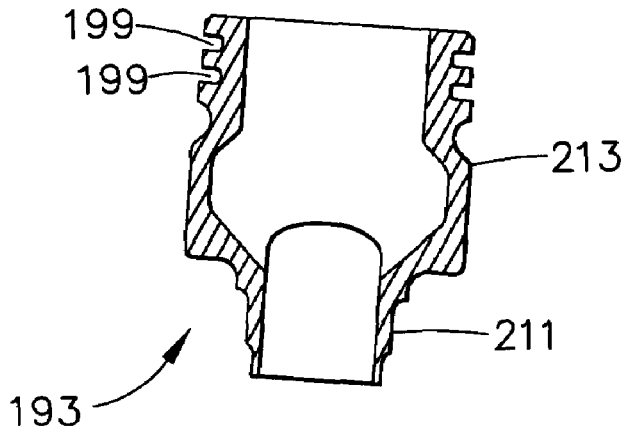
FIG. 14 is a detail view of a buffer air conduit terminating fitting used in the buffer air port of FIG. 12.

The buffer air conduit termination fitting 193, shown in the cross-section view of FIG. 14, may include a cylindrical inboard fitting section 211 for attachment to an outboard end of the buffer air conduit 79. The buffer air conduit termination fitting 193 may further include a flared outboard fitting section 213 which includes the two circumferential grooves 199. The outboard fitting section 213 may be sized to fit into the buffer air cap body 203, as shown in FIG. 12. Other features and functions of the buffer air port 59 may be similar to those of the inlet assembly 51.

In still another embodiment having the inlet assembly 51, the vent assembly 53, the first scavenge port 55, the second scavenge port 57, and the buffer air port 59, the configurations of the vent assembly 53, the first scavenge port 55, and the second scavenge port 57 may be similar to one another, and the configurations of the inlet assembly 51 and the buffer air port 59 may be as described above.

It should be understood, of course, that the foregoing relates to exemplary embodiments of the invention and that modifications may be made without departing from the spirit and scope of the invention as set forth in the following claims.

We claim:

1. A lubrication system suitable for providing lubricant from a lubricant supply line to a bearing support operating in an engine casing, said lubrication system comprising an inlet conduit having an inboard end attached to the bearing support and an outboard end for receiving the lubricant;

a lubricant inlet assembly attached to said inlet conduit outboard end, said lubricant inlet assembly including an inlet cap having a receptacle and an inlet cap body, said receptacle configured to mate with the lubricant supply line, said inlet cap body having an outer cap enclosing an inner cap;

an inlet conduit termination fitting having an outboard fitting section with a circumferential groove and disposed inside said inner cap, and an inboard fitting section attached to said inlet conduit outboard end; and an inlet o-ring disposed in said circumferential groove.

2. The lubrication system of claim 1 wherein said outer cap comprises a convoluted wall.

3. The lubrication system of claim 1 wherein said inlet cap further comprises a cap base for attachment to the engine casing.

4. The lubrication system of claim 3 wherein said cap base comprises a circular recess.

5. The lubrication system of claim 4 wherein said cap base comprises a circular ridge enclosing said circular recess.

6. The lubrication system of claim 5 wherein said lubricant inlet assembly further comprises a gasket disposed against said cap base, said gasket ridge enclosing said circular ridge.

7. The lubrication system of claim 6 wherein said gasket comprises a low conductivity insulator.

8. The lubrication system of claim 1 wherein said lubricant inlet assembly further comprises a cap heat shield enclosing said inlet cap.

9. The lubrication system of claim 8 wherein said cap heat shield comprises a cylindrical shield and at least one mounting bracket.

10. The lubrication system of claim 1 wherein said lubricant inlet assembly further comprises a conduit heat shield.

11. The lubrication system of claim 10 wherein said conduit heat shield comprises a flared section.

12. The lubrication system of claim 10 wherein said conduit heat shield comprises a circumferential discontinuity.

13. The lubrication system of claim 1 further comprising:
a scavenge port, and
a scavenge conduit having an inboard end attached to the bearing support and an outboard end attached to said scavenge port.

14. The lubrication system of claim 13 wherein said scavenge port comprises:
an elbow cap,
a conduit termination fitting disposed inside said elbow cap, and
an o-ring disposed between said elbow cap and said conduit termination fitting.

15. The lubrication system of claim 14 wherein said elbow cap comprises a cylindrical elbow.

16. The lubrication system of claim 14 wherein said conduit termination fitting comprises a flared outboard fitting section.

17. The lubrication system of claim 1 further comprising:
a buffer air port, and
a buffer air conduit having an inboard end attached to the bearing support and an outboard end attached to said buffer air port.

18. The lubrication system of claim 17 wherein said buffer air port comprises a pair of buffer air piston rings.

19. A lubricant inlet assembly suitable for attachment to an engine casing at an outboard end of an inlet conduit used for providing lubricant from a lubricant supply line to a bearing support attached to an inboard end of the inlet conduit, said lubrication system comprising
an inlet cap having a receptacle configured to mate with the lubricant supply line, a cap body having an outer cap enclosing an inner cap, and a cap base, said outer cap having a convoluted wall;
an inlet conduit termination fitting disposed inside said inner cap and including a first section with a circumferential groove and a second section attached to the outboard end of the inlet conduit; and
an inlet o-ring disposed in said circumferential groove.

20. The lubricant inlet assembly of claim 19 further comprising a low-conductivity insulator disposed between said cap base and the engine casing.

21. The lubricant inlet assembly of claim 19 further comprising a cap heat shield enclosing said inlet cap.

22. The lubricant inlet assembly of claim 19 further comprising a conduit heat shield enclosing the inlet conduit.

23. A lubricant inlet assembly suitable for attachment to an engine casing at an outboard end of an inlet conduit used for providing lubricant from a lubricant supply line to a bearing support attached to an inboard end of the inlet conduit, said lubrication inlet assembly comprising
an inlet cap having a receptacle configured to mate with the lubricant supply line, and a cap base attached to the engine casing;
a cap heat shield enclosing said inlet cap; and
an inlet conduit termination fitting attached to the outboard end of the inlet conduit and disposed inside said inlet cap.

24. The lubricant inlet assembly of claim 23 further comprising a conduit heat shield enclosing the inlet conduit.

25. The lubricant inlet assembly of claim 23 further comprising a low-conductivity insulator disposed between said cap base and the engine casing.

26. A scavenge port suitable for attachment to an engine casing at an outboard end of a scavenge inlet conduit used for removing lubricant from a bearing support attached to an inboard end of the scavenge conduit, said scavenge port comprising
a cap having a receptacle configured to mate with a lubricant removal line, and a cap base attached to the engine casing;
a conduit termination fitting attached to the outboard end of the scavenge conduit and disposed inside said cap; and
a conduit heat shield enclosing the scavenge conduit so as to block thermal radiation from the engine casing.

27. The scavenge port of claim 26 further comprising a cap heat shield enclosing said cap.

28. The scavenge port of claim 26 further comprising a low-conductivity insulator disposed between said cap base and the engine casing.

29. A vent assembly suitable for attachment to an engine casing at an outboard end of a vent inlet conduit used for venting a bearing support attached to an inboard end of the vent conduit, said vent assembly comprising
a cap having a receptacle configured to mate with a vent line, and a cap base attached to the engine casing, said cap base having a circular ridge enclosing a circular recess;
a low-conductivity insulator disposed between said cap base and the engine casing, said low-conductivity insulator enclosing said circular ridge; and
a conduit termination fitting attached to the outboard end of the vent conduit and disposed inside said cap.

30. The scavenge port of claim 29 further comprising a cap heat shield enclosing said cap.

31. The scavenge port of claim 29 further comprising a conduit heat shield enclosing said vent conduit.

32. A lubrication system suitable for a bearing support operating in an engine casing, said lubrication system comprising
an inlet conduit having an inboard end attached to the bearing support and an outboard end for receiving the lubricant;
a lubricant inlet assembly attached to said inlet conduit outboard end, said lubricant inlet assembly including an inlet cap having a receptacle configured to mate with a lubricant supply line, a cap body with an outer cap enclosing an inner cap, and an inlet cap base;

an inlet conduit termination fitting with a circumferential groove and an o-ring disposed in said groove, said inlet conduit termination fitting attached to said inlet conduit outboard end;

a scavenge conduit having an inboard end attached to the bearing support and an outboard end for access in removing the lubricant;

a scavenge port attached to said scavenge conduit outboard end, said scavenge port including an elbow cap having a receptacle configured to mate with a lubricant removal line, a cap body having an outer cap enclosing an inner cap, and a cap base;

a conduit termination fitting with a circumferential groove and an o-ring disposed in said groove, said scavenge port conduit termination fitting attached to said scavenge conduit outboard end;

a buffer air conduit having an inboard end attached to the bearing support and an outboard end;

a buffer air port attached to said buffer air conduit outboard end, said buffer air port including a buffer air cap having a cap body, a buffer air elbow, and a buffer air cap base; and a buffer air conduit termination fitting with two circumferential grooves and two piston rings disposed in respective said grooves, said buffer air conduit termination fitting attached to said buffer air conduit outboard end.

33. The lubrication system of claim 32 further comprising at least one cap heat shield enclosing at least one of said inlet cap, said elbow cap, and said buffer air cap.

34. The lubrication system of claim 32 further comprising at least one conduit heat shield enclosing at least one of said inlet conduit, said scavenge conduit, and said buffer air conduit.

35. The lubrication system of claim 32 further comprising at least one low conductivity insulator disposed between the engine casing and at least one of said inlet cap base, said cap base, and said buffer air cap base.

36. A lubrication system suitable for retrofitting a shaft-driven engine having a bearing support mounted to an engine casing, the engine further having inboard ends of an inlet conduit, at least one scavenge conduit, a vent conduit, and a buffer air conduit attached to the bearing support, said lubrication system comprising a lubricant inlet assembly including an inlet cap having an inlet receptacle configured to mate with a lubricant supply line, an inlet cap body with an outer inlet cap enclosing an inner inlet cap, and an inlet cap base for attachment to the engine casing, said outer inlet cap having a convoluted wall;

an inlet conduit termination fitting with a circumferential groove and an inlet o-ring disposed in said groove, said inlet conduit termination fitting attached to an outboard end of the inlet conduit;

a cap heat shield enclosing said inlet cap, a conduit heat shield attached to the inlet conduit, and a low conductivity insulator disposed between said inlet cap base and the engine casing;

a vent assembly including an elbow cap having an outer cap enclosing an inner cap, and a cap base for attachment to the engine casing, said outer cap having a convoluted wall;

a conduit termination fitting with a circumferential groove and an o-ring disposed in said groove, said vent assembly conduit termination fitting attached to an outboard end of the vent conduit;

a cap heat shield enclosing said vent assembly elbow cap, a conduit heat shield attached to the vent conduit, and a low conductivity insulator disposed between said vent assembly cap base and the engine casing;

a first scavenge port including an elbow cap configured to mate with a first lubricant removal line, a cap body having an outer cap enclosing an inner cap, and a cap base for attachment to the engine casing, said first scavenge port outer cap having a convoluted wall;

a conduit termination fitting with a circumferential groove and an o-ring disposed in said groove, said first scavenge port conduit termination fitting attached to an outboard end of the first scavenge conduit;

a cap heat shield enclosing said first scavenge port elbow cap, a conduit heat shield attached to the first scavenge conduit, and a low conductivity insulator disposed between said first scavenge port cap base and the engine casing;

a buffer air port including a buffer air cap having a buffer air cap body, a buffer air elbow and a buffer air cap base for attachment to the engine casing; and a buffer air conduit termination fitting with two circumferential buffer air grooves and two buffer air piston rings disposed in respective said buffer air grooves, said buffer air conduit termination fitting attached to an outboard end of the buffer air conduit; and a cap heat shield enclosing said buffer air cap, a conduit heat shield attached to the buffer air conduit, and a low conductivity insulator disposed between said buffer cap air base and the engine casing.

37. The lubrication system of claim 36 further comprising a second scavenge port including an elbow cap configured to mate with a second lubricant removal line, a cap body having an outer cap enclosing an inner cap and a cap base for attachment to the engine casing, said second scavenge port outer cap having a convoluted wall;

a conduit termination fitting with a circumferential groove and an o-ring disposed in said groove, said second scavenge port conduit termination fitting attached to an outboard end of a second scavenge conduit; and a cap heat shield enclosing said second scavenge port elbow cap, a conduit heat shield attached to the second scavenge port conduit, and a low-conductivity insulator disposed between said second scavenge port cap base and the engine casing.

38. The lubrication system of claim 36 wherein said cap heat shield comprises a thin-walled cylindrical shield attached to an L-shaped mounting bracket.

39. The lubrication system of claim 36 wherein said cap heat shield comprises a nickel-based alloy.

40. A method of providing lubrication from a lubricant supply line to a bearing support operating in a engine casing, the engine casing having inboard ends of an inlet conduit, a scavenge conduit, a vent conduit, and a buffer air conduit attached to the bearing support, said method comprising the steps of attaching an outboard end of the inlet conduit to a lubricant inlet assembly, said lubricant inlet assembly including an inlet conduit termination fitting having an inlet o-ring disposed in a circumferential groove, said inlet conduit termination fitting attached to said inlet conduit outboard end;

an inlet cap having an inlet receptacle configured to mate with a lubricant supply line, an inlet cap body with an outer inlet cap enclosing an inner inlet cap, and an inlet cap base for attachment to the engine casing, said outer inlet cap having a convoluted wall, said inner inlet cap enclosing said inlet o-ring; and providing lubricant to the bearing support via said inlet receptacle and the lubricant supply line.

41. The method of claim 40 further comprising the steps of providing a cap heat shield enclosing said inlet cap so as to block thermal radiation from the engine casing; and providing a conduit heat shield attached to the inlet conduit so as to block radiation from the engine casing.

42. The method of claim 40 further comprising the steps of attaching an outboard end of the scavenge conduit to a scavenge port, said scavenge port including a conduit termination fitting having an o-ring disposed in a circumferential groove, said scavenge port conduit termination fitting attached to said scavenge conduit outboard end;

an elbow cap having a receptacle configured to mate with a lubricant removal line, a cap body with an outer cap enclosing an inner cap, and a cap base for attachment to the engine casing, said scavenge port outer cap having a convoluted wall, said scavenge port inner cap enclosing said scavenge port o-ring; and removing lubricant from the bearing support via said scavenge port receptacle and the lubricant removal line.

43. The method of claim 42 further comprising the steps of providing a cap heat shield enclosing said elbow cap so as to block radiation from the engine casing; and providing a conduit heat shield attached to the scavenge conduit so as to block radiation from the engine casing.

44. The method of claim 40 further comprising the steps of attaching an outboard end of the vent conduit to a vent assembly, said vent assembly including a conduit termination fitting having an o-ring disposed in a circumferential groove, said vent conduit termination fitting attached to said vent conduit outboard end;

a cap having a receptacle configured to mate with a vent line, a cap body with an outer cap enclosing an inner cap, and a cap base for attachment to the engine casing, said vent outer cap having a convoluted wall, said vent inner cap enclosing said vent o-ring; and venting the bearing support via said vent assembly receptacle and the vent line.

45. The method of claim 40 further comprising the steps of attaching an outboard end of the buffer air conduit to a buffer air port, said buffer air port including a buffer air conduit termination fitting having a pair of buffer air piston rings, each said buffer air piston ring disposed in a respective circumferential buffer air groove, said buffer air conduit termination fitting attached to said buffer air conduit outboard end;

a buffer air cap having a buffer air receptacle configured to mate with a buffer air line, and a buffer air cap base for attachment to the engine casing, said buffer air cap enclosing said buffer air piston rings; and buffering the bearing support via said buffer air line.

* * * * *